United States Patent [19]

Kruper et al.

[11] 4,399,019

[45] Aug. 16, 1983

[54] ULTRA-HIGH CURRENT DENSITY ELECTROPLATING CELL

[75] Inventors: Wayne A. Kruper, Willowick; Ralph R. Green, Hiram, both of Ohio

[73] Assignee: Imperial Clevite Inc., Rolling Meadows, Ill.

[21] Appl. No.: 285,593

[22] Filed: Jul. 21, 1981

[51] Int. Cl.[3] ..... C25D 21/00; C25D 21/04

[52] U.S. Cl. ..... 204/212; 204/272; 204/275

[58] Field of Search ..... 204/212, 272, 275, 273

[56] References Cited

U.S. PATENT DOCUMENTS

| | | | |
|---|---|---|---|
| 2,137,806 | 11/1938 | Paige | 204/212 |
| 2,406,956 | 9/1946 | Matthews | 204/272 |
| 2,431,949 | 12/1947 | Martz | 204/272 |
| 4,235,691 | 11/1980 | Loquist | 204/212 |

*Primary Examiner*—T. M. Tufariello
*Attorney, Agent, or Firm*—Russell E. Baumann

[57] ABSTRACT

The electroplating cell includes a reservoir of electroplating solution into which a workpiece supporting and locating structure is able to be lowered. The workpiece supporting structure supports and locates a plurality of semi-cylindrical bearing elements in a column around a cylindrical anode structure. A plating cavity is defined between the bearing elements and the anode structure. The anode structure includes a tubular anode basket having a plurality of apertures therein and a woven liner along its interior. A copper rod is attached to the anode basket and extends along its central axis for supplying electrical potential to pellets of the plating metal disposed within the anode basket and for rotating the anode basket. A plurality of vanes are attached to the exterior of the anode basket for rotation through the plating cavity to stir the plating solution. A first pump circulates plating solution from the reservoir into the plating cavity at a rate of about 20 to 60 gallons per minute and a second pump draws plating solution out of the anode basket at a rate of less than 10 gallons per minute. The remaining solution escapes from the top of the plating cavity and returns to the plating reservoir.

17 Claims, 2 Drawing Figures

ULTRA-HIGH CURRENT DENSITY ELECTROPLATING CELL

BACKGROUND OF THE INVENTION

This application pertains to the art of electroplating and more particularly to high current density deposition of electroplate. The invention is particularly applicable to the electrodeposition of lead-tin alloys on sleeve bearings and will be described with particular reference thereto. It will be appreciated, however, that the invention has broader applications including the electrodeposition of other metals and alloys onto other workpieces.

In high current density depositions of electroplate, the current density is proportional to the square root of the relative movement between the electroplating solution and the workpiece. Heretofore, high current density depositions of electroplate have been achieved by moving the workpiece relative to the plating solution or by moving the plating solution relative to the workpiece. To plate sleeve bearings by moving them relative to the solution, gives rise to many problems. To withstand the rotational forces encountered when spinning a column of bearings about an anode, secure holding devices were necessary. Such holding devices tended to make loading and unloading of workpieces difficult and time-consuming. Further, these holding devices needed to be dynamically balanced to spin smoothly. In addition to the mechanical problems encountered in the rotating holding devices, the rotation caused churning of the plating solution. This churning required that the plating cell be totally enclosed to prevent the solution from splashing out of the cell and to prevent air from being entrained in the plating solution and oxidizing the plating chemicals. Such total enclosure of the plating cell further hindered loading and unloading operations.

Moving the plating solution relative to the workpiece required moving a large volume of solution through the plating fixture. Typically, electroplating a ten-inch inside diameter bearing surface 26 inches long with a current density of 800 amperes per square foot required 1750 gallons per minute of solution to be pumped between the anode and the workpiece. Problems arose in pumping this large quantity of highly corrosive plating solution through this small volume. The high pressures necessary to move the plating solution required elaborate holding devices to hold the bearings securely in place. These holding devices again tended to be difficult to load and unload. Further, these high pressures tended to compound the difficulties in loading and unloading the workpieces and to entrain air in the plating solution.

The prior art high current density electroplating cells commonly used either a solid, soluble anode or an insoluble anode. A primary problem with soluble anodes in high current density systems is that they are dissolved quickly. For example, electroplating a ten-inch inside diameter bearing surface 26 inches long with a current density of 800 amperes per square foot, dissolves 37½ pounds of lead-tin per hour from the anode. This is the equivalent to a standard two-inch diameter anode.

A principal problem with insoluble anodes is that they degrade the electroplating solution. The insoluble anodes liberate oxygen which destroys some of the constituents of the plating solution. Further insoluble anodes are not truly insoluble but rather small amounts of contaminant metals are dissolved and suspended in the plating solution.

The present invention overcomes these problems and others while it also provides a high current density electrolytic deposition system which is practical for production use.

SUMMARY OF THE INVENTION

In accordance with the present invention, there is provided an electroplating cell for high current density electroplating. The cell includes an anode structure for holding a source of plating metal and an anode electrical conductor for supplying a positive electrical potential to the anode structure. At least one agitating vane is disposed adjacent the anode structure which is rotated around the anode structure by a rotating means. A locating means fixes the physical relationship of workpieces to be electroplated with the anode structure. A cathode electrical conductor supplies a negative electrical potential to the workpieces.

In accordance with a more limited aspect of the invention, the anode structure has a tubular outer wall which is porous to permit the migration of plating ions and of plating solution. A plating cavity is defined between the anode structure outer wall and the inner wall of workpieces to be plated. The vanes rotate and plating solution is circulated through the plating cavity.

A principal advantage of the present invention resides in a relatively low volume of electroplating solution being moved between the anode structure and the workpieces. This reduces the pumping pressure and the inherent agitation and loading problems encountered in connection with high pressure pumping.

Another advantage of the present invention resides in its facilitating faster production rates by facilitating loading and unloading of workpieces and by eliminating anode changes.

Yet another advantage of the present invention is that it reduces maintenance.

Still further advantages will become apparent to those of ordinary skill in the art upon reading the following detailed description.

BRIEF DESCRIPTION OF THE DRAWINGS

The invention may take physical form in certain parts and arrangements of parts a preferred embodiment of which is illustrated in the figures. The figures are for purposes of illustrating the preferred embodiment of the invention only and are not to be construed as limiting the invention, wherein the figures show.

DETAILED DESCRIPTION OF THE PREFERRED EMBODIMENT

Figure 1:
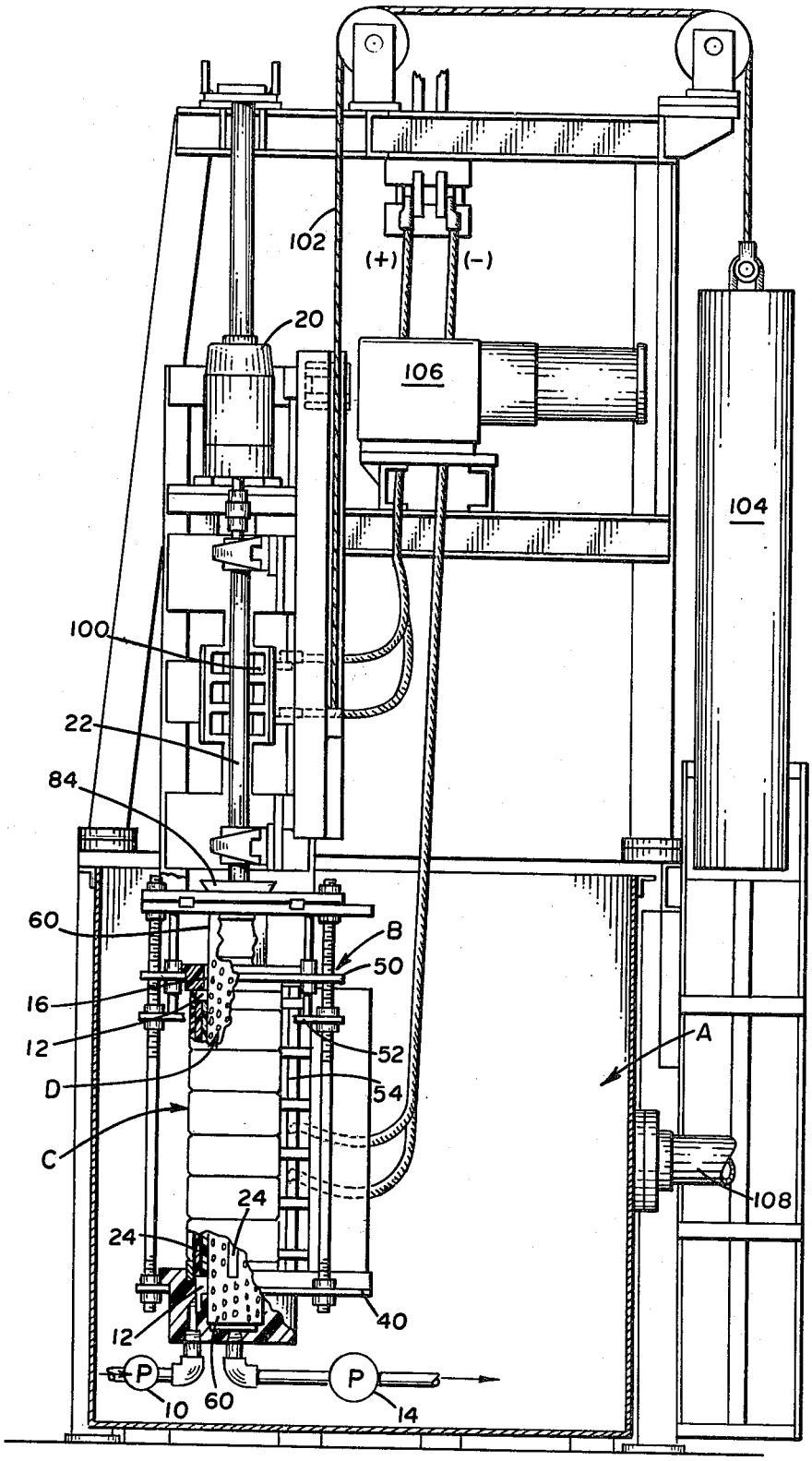
FIG. 1 is a side elevational view in partial section of a high current density electroplating apparatus in accordance with the present invention.

Referring to FIG. 1, the electroplating apparatus includes an electroplating solution reservoir or tank A which contains electroplating solution. Removably disposed within the reservoir A is a workpiece supporting and locating structure B for supporting a plurality of workpieces C and locating them in the appropriate proximity to an anode structure D. Briefly stated, a first plating solution pump 10 pumps plating solution from the reservoir A into a thin annular plating cavity 12 between the workpieces C and the anode structure D. A second pump 14 draws a relatively small, controlled amount of the plating solution from the plating cavity 12 through the anode structure D and returns it to the reservoir A. The remaining plating solution which is pumped into the plating cavity 12 by pump 10 passes through a return gap 16 at the top of the plating cavity back to the reservoir A. In this manner, plating solution is circulated continuously through the cavity 12 between the anode structure and the workpieces. To increase the movement of the plating solution relative to the workpieces, a motor 20 rotates a rod 22 which is connected with the anode D. Still greater movement of the plating solution is achieved with vanes or stirrers 24 which are attached to the anode structure D to rotate through the plating cavity 12. The pumps 10 and 14 and the rotation of the anode structure and its attached vanes each assist in moving the plating solution relative to the workpieces with sufficient velocity to obtain uniform plating at the selected, high current densities. Depending on the selected current density, either the pumps or rotation alone may be sufficient or both may be required.

Figure 2:
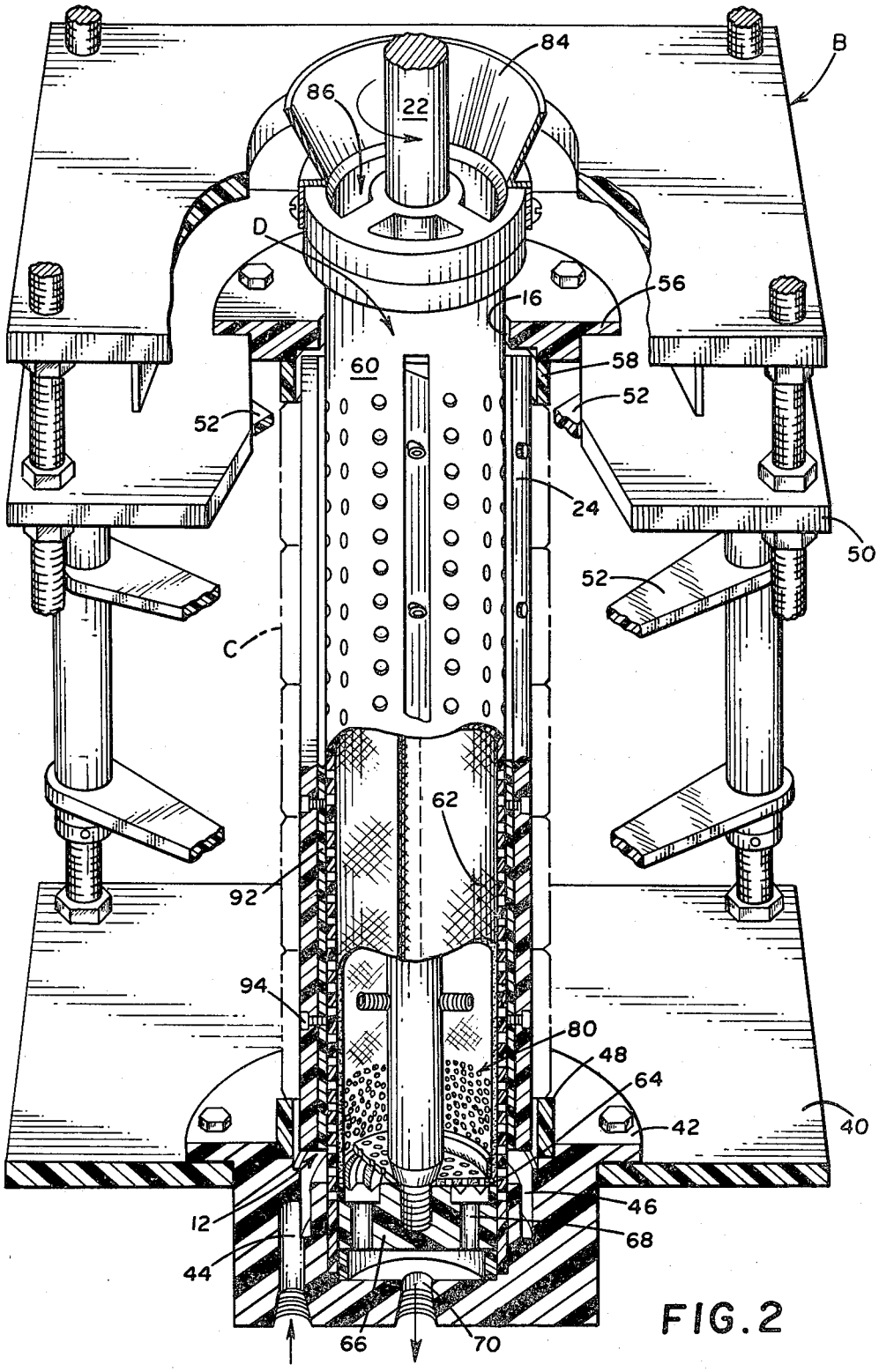
FIG. 2 is a side elevational view in partial section of the anode and workpiece supporting structure of the electroplating apparatus of FIG. 1.

With particular reference to FIG. 2 and continuing reference to FIG. 1, the workpiece support and locating means B includes a lower support shelf 40 which supports a lower bushing 42 for rotatably supporting the lower end of the anode structure D. The lower bushing 42 has a first plating solution flow channel 44 which connects the reservoir A with the plating cavity 12. An annular distribution ring 46 is connected with channel 44 to distribute the solution evenly around the circumference of the plating cavity 12. Disposed near the upper portion of the lower bushing 42 is a first workpiece positioning ring 48 for supporting the workpieces.

Connected between the lower support shelf 40 and an upper support shelf 50 are vertical support members on which a plurality of arms 52 are rotatably mounted. The arms 52 are rotatable between a first position in which they bias copper cathode bars 54 against the workpieces C to hold them in the appropriate position and a second position in which the cathode bars 54 are disposed away from the workpieces to allow them to be removed. The cathode bars 54 supply a negative potential to the workpieces to attract metallic ions. The number and physical characteristics of the arms 52 and cathode bars 54 may vary with the size and nature of the workpieces to be plated. An upper bushing 56 is mounted in the upper support shelf 50 and defines the return gap 16 between itself and the anode structure D. Disposed below the bushing 56 is a second workpiece positioning ring 58. The workpiece positioning rings 48 and 58 are selected to have generally the same cross section as the workpieces to be plated and the appropriate heights such that the workpieces and the positioning rings fully fill the area between lower and upper bushings 42 and 56. In this manner, the annular plating cavity 12 is a closed region with limited access.

The workpieces, in the preferred embodiment, are sleeve bearings such as main, rod, or flanged bearings for various types of motors. The sleeve bearings are semi-cylindrical sleeves which are adapted to be positioned adjacent each other to form a cylindrical bearing. Commonly the bearings are disposed around the main drive shaft of the motor. In such applications, it is desirable for the bearings to have their inner, bearing surface plated with a lead alloy. In conventional automobiles, the bearing surface of the sleeve bearings is plated with 0.001 inches of the lead alloy. For a high performance engine, the lead alloy coating is commonly on the order of 0.0005 inches, whereas for a heavy duty locomotive engine plating is more commonly 0.002 to 0.004 inches. The plating alloy is commonly a lead-tin alloy containing sufficient tin to retard the corrosion of the lead by engine oils. Although in the preferred embodiment the workpieces are sleeve bearings for motors, it will be appreciated that the inventive principals of the present invention may be utilized with other workpieces.

With continued reference to FIG. 2, the anode structure D includes a porous anode basket 60 having a tubular wall which is sufficiently porous that the metallic ions can traverse its walls. In the preferred embodiment, the tubular wall has a plurality of drilled apertures on the order of $\frac{1}{8}$ to $\frac{1}{4}$ of an inch in diameter. The apertures are placed at regular intervals around its periphery and along its length and encompass 25 to 35 percent of the surface area. Alternately, the anode basket may be a porous material, may have slits or apertures of other dimensions, sizes and shapes, or the like. Inside the anode basket 60 is a porous liner 62. The liner 62 helps prevent small pieces of the anode metal from physically passing through the apertures in the anode basket 60. It will be appreciated that if the apertures in the anode basket are sufficiently small, the liner 62 would be superfluous. The liner is constructed of a material which is not corroded by the electroplating solution such as DYNEL cloth, although various other woven and unwoven plastic and nonplastic materials may be used. The anode basket 60, in the preferred embodiment, is constructed of chlorinated polyvinyl chloride although other plastic materials, non-conductive materials, and even metallic materials which are less reactive in the electroplating environment than the plating metal can be utilized, if desired.

At the lower end of the anode basket is a screen 64 disposed over a lower end piece 66 having passages 68 therein which connect with a second plating solution flow channel 70 in the lower bushing 42. This allows the pump 14 to draw plating solution through the apertures in the anode basket 60, through the porous liner 62, into the interior of the anode basket. From the interior of the anode basket, the plating solution is drawn through the screen 64, passages 68, and the second flow channel 70 to the pump 14 and reservoir A.

With continued reference to FIG. 2, a plurality of pieces 80 of the plating metal are disposed within the anode structure. In the preferred embodiment, the pieces 80 are lead-tin shot or pellets. As the electroplating operation progresses, lead and tin ions from the shot are dissolved into the electrolyte solution and plated on the workpieces. As the shot 80 is dissolved, the shot pieces become smaller and settle toward the bottom of the anode structure. When the level of shot becomes low, additional shot is poured into an upper funnel arrangement 84 through shot loading apertures 86 without interrupting the electroplating operation. The shot may be added automatically or manually at regular intervals. In the preferred embodiment, the anode structure extends above the top of the uppermost workpiece a significant distance to create a head of shot. In this manner, as the shot is dissolved, the head is reduced but shot is always present adjacent all the workpieces. In the preferred embodiment, the head is chosen of a sufficient volume that under normal plating operations about an hour is required for it to be depleated.

The rod 22 in the preferred embodiment is a copper rod for conducting a positive electrical potential to the lead-tin shot 80 in the anode structure 60. The conductive rod 22 is connected with the anode basket such that the rod and anode basket rotate together. Optionally, the rod 22 may be plated with a metal that is resistant to the particular electroplating solution.

To increase the flow of electroplating solution past the surface of the workpieces to be plated, a plurality of vanes 24 are connected to the surface of the anode basket 60 to rotate through the plating cavity 12 as the anode structure rotates. Each vane is detachably connected with a vane base portion 92 by a plurality of set screws or other removable attaching means. This enables the vanes to be changed or replaced with vanes particularly suited to the workpiece to be plated. The vanes 24, in the preferred embodiment, are rigid plastic and are disposed to rotate closely adjacent, but not touching, the bearing surfaces to be plated. Alternately, the vanes may brush against the surface of the bearings to be plated. If the vanes and the surfaces to be plated contact each other, it is preferred that the vanes be somewhat resilient such as a windshield wiper blade or a brush. Further, the vanes need not be linear, as illustrated. Rather, they may spiral around the anode basket, be angularly disposed, be intermittently disposed, or the like. Optionally, the vanes 24 could be rotated independently from the plating basket 60.

With reference again to FIG. 1, a plurality of electrical brushes 100 supply the positive potential to the conductive rod 22 as it rotates. A raising and lowering means includes a cable 102 which is connected with the supporting and locating means B at one end and with a counterweight 104 at the other. A motor 106 selectively moves the cable 102 to raise or lower the workpiece supporting and locating means B, the workpieces C, and the anode structure D into and out of the plating solution. Optionally, the reservoir A may be connected at 108 with a storage tank (not shown) to increase the amount of plating solution available.

Looking to the specific operating parameters, the flow rate of the plating solution through the plating cavity 12 varies with the plating conditions. The relatively high electrical resistance to the current moving between the lead-tin shot 80 in the anode basket 60 and the workpieces C cause resistance heating. This resistance heating may cause a temperature rise of several degrees between when the plating solution first enters the plating cavity 12 at the bottom and when it leaves the plating cavity through the gap 16 at the top. Because the plating rate and alloy composition varies with temperature, a significant difference in the temperature of the plating solution between the top and bottom of the plating cavity 12 would cause an uneven plating of the workpieces. Accordingly, the flow rate through the plating cavity and the pumping rate of pump 10 must be sufficiently high that the temperature gradient across the plating cavity is maintained within acceptable tolerances. Further, the pumping rate should be sufficiently high that the electrolyte solution does not underconcentrate in the plating cavity 12 or overconcentrate and form salt deposits in the anode basket 60. For a plating cavity which has a 4 inch inner diameter, a $7\frac{1}{2}$ inch outer diameter, and a 12 inch height when used with a plating current of about 1100 amps per square foot to plate a lead-tin alloy which is about 85 percent lead and 15 percent tin, a pumping rate by pump 10 of 20 to 60 gallons per minute has been found to be acceptable with a pumping rate of 50 gallons per minute preferred. The pumping rate of less than 10 gallons per minute for pump 14 has been found to be acceptable with a preferred pumping rate of 3 to 5 gallons per minute. It has also been found that the elimination of pump 14 or reversing its pumping direction so that it pumps into the anode basket produces satisfactory results. However, pumping into the anode basket tends to force dirt and contaminants out of the anode structure into the plating cavity which may tend to lower the quality of the plating operation.

The invention has been described with reference to the preferred embodiment. Obviously modifications and alterations will occur to others upon reading and understanding the preceding description of the preferred embodiment. It is our intention that our invention include all such modifications and alterations insofar as they come within the scope of the appended claims or the equivalents thereof.

Having thus described a preferred embodiment of our invention, we now claim our invention to be:

1. An electroplating apparatus comprising:

an anode structure containing a source of plating metal;

at least one agitating vane disposed in a plating cavity disposed adjacent the anode structure;

rotating means for rotating the vane through the plating cavity;

an anode electrical conductor for supplying a positive potential to the anode structure;

a locating means for locating workpieces in a fixed physical relationship with the anode structure so as to form said plating cavity; and, a cathode electrical conductor for supplying a negative potential to the workpieces to be plated.

2. The electroplating apparatus as set forth in claim 1 wherein the anode structure includes an anode basket having a hollow interior for receiving the plating metal and having a tubular wall which is porous to permit the migration of plating ions therethrough.

3. The electroplating apparatus as set forth in claim 2 wherein the vane is connected with the tubular wall of the anode basket and wherein the rotating means rotates the annular basket and the vane together.

4. The electroplating apparatus as set forth in claim 3 wherein a plurality of vanes are attached to the anode basket for rotation therewith.

5. The electroplating apparatus as set forth in claim 4 wherein the vanes are substantially triangular in cross section.

6. The electroplating apparatus as set forth in claim 4 wherein the vanes are detachable, whereby the vanes are replaceable with vanes particularly suited to workpieces to be plated.

7. The electroplating cell as set forth in claim 2 wherein the tubular wall of the anode basket has a plurality of enlarged apertures therein whereby the flow of plating solution therethrough is permitted.

8. The electroplating cell as set forth in claim 7 wherein the apertures encompass from about 25 to about 35 percent of the surface area of the tubular wall.

9. The electroplating cell as set forth in claim 7 further including a porous liner disposed inside the tubular outer wall.

10. The electroplating apparatus as set forth in claim 9 wherein said porous liner is a woven material.

11. The electroplating apparatus as set forth in claim 1 wherein the locating means locates the workpieces such that the plating cavity is defined between the anode structure and the workpieces.

12. The electroplating apparatus as set forth in claim 11 further including a first plating solution flow channel for supplying plating solution into said plating cavity.

13. The electroplating apparatus as set forth in claim 12 wherein said anode structure includes an anode basket for holding a pelletized source of plating metal, the anode basket having a porous outer wall which permits the flow of plating solution therethrough, and further including a second plating solution flow channel in communication with the interior of the anode basket.

14. The electroplating apparatus as set forth in claim 13 further including a first pump for pumping plating solution through said first plating solution flow channel into the plating cavity and a second pump for pumping plating solution through said second plating solution channel from the interior of the anode basket.

15. The electroplating apparatus as set forth in claim 2 wherein said anode electrical conductor is an electrically conductive rod and said rotating means includes a motor for supplying rotary forces to said electrically conductive rod, said rod extending into the interior of said anode basket and being attached thereto such that the anode basket rotates with said conductive rod.

16. The electroplating apparatus as set forth in claim 15 further including brushes for supplying positive electrical potential to said conductive rod such that said conductive rod connects the plating metal in the anode basket with the source of positive potential.

17. The electroplating apparatus as set forth in claim 16 wherein said conductive rod is copper.

* * * * *